US007980274B2

(12) United States Patent
Pages et al.

(10) Patent No.: US 7,980,274 B2
(45) Date of Patent: Jul. 19, 2011

(54) ROTARY DOBBY, A LOOM INCLUDING SUCH A DOBBY, AND A METHOD OF CONTROLLING SUCH A DOBBY

(75) Inventors: Jean-Pierre Pages, Faverges (FR); Robert Nocenti, Chevaline (FR); Willy Galinaitis, Albertville (FR)

(73) Assignee: Staubli Faverges, Faverges (FR)

( * ) Notice: Subject to any disclaimer, the term of this patent is extended or adjusted under 35 U.S.C. 154(b) by 1104 days.

(21) Appl. No.: 11/783,381

(22) Filed: Apr. 9, 2007

(65) Prior Publication Data

US 2007/0246950 A1 Oct. 25, 2007

(30) Foreign Application Priority Data

Apr. 11, 2006 (FR) ..... 06 03203

(51) Int. Cl.
*D03C 1/00* (2006.01)

(52) U.S. Cl. ..... 139/66 R; 139/66 A

(58) Field of Classification Search ..... 139/66 R, 139/76; 74/567
See application file for complete search history.

(56) References Cited

U.S. PATENT DOCUMENTS

| | | | | |
|---|---|---|---|---|
| 4,730,641 | A | 3/1988 | Schwarz | |
| 5,125,435 | A * | 6/1992 | Froment | 139/455 |
| 5,214,834 | A * | 6/1993 | Froment | 29/434 |
| 5,335,564 | A * | 8/1994 | Vinciguerra | 74/567 |
| 5,908,050 | A | 6/1999 | Froment | |
| 5,918,645 | A * | 7/1999 | Froment et al. | 139/66 R |
| 6,938,647 | B2 * | 9/2005 | Pages et al. | 139/66 R |

FOREIGN PATENT DOCUMENTS

| | | |
|---|---|---|
| EP | 0 185 780 | 7/1986 |
| EP | 0 607 632 | 7/1994 |
| EP | 1 111 106 | 6/2001 |
| FR | 2 757 882 | 7/1998 |

* cited by examiner

*Primary Examiner* — Shaun R Hurley
*Assistant Examiner* — Andrew W Sutton
(74) *Attorney, Agent, or Firm* — Dowell & Dowell, P.C.

(57) ABSTRACT

A dobby includes two controlled latches for coupling a drive element mounted to a main drive shaft of the dobby and an actuator element in rotation. A first resilient element resiliently biases each of the latches towards a configuration in which their respective bearing surfaces are engaged with corresponding surfaces of the actuator element. Control members are provided for moving the latches against the action of the first resilient element and that act directly on the first latch and indirectly on the second latch so as to move the first latch against the first resilient element to thereby disengage its bearing surface with a corresponding surface of the actuator element while the second latch remains in a configuration in which its bearing surface is engaged with another corresponding surface of the actuator element.

13 Claims, 8 Drawing Sheets

ROTARY DOBBY, A LOOM INCLUDING SUCH A DOBBY, AND A METHOD OF CONTROLLING SUCH A DOBBY

BACKGROUND OF THE INVENTION

1. Field of the Invention

The invention relates to a rotary dobby for a loom, and to a loom fitted with such a dobby. The invention also relates to a subassembly belonging to such a dobby, and to a method of controlling such a dobby.

2. Brief Description of the Related Art

It is known, e.g. from EP-A-1 111 106, to fit a rotary dobby with two compression latches serving to couple a drive disk to an eccentric which forms an actuator element for actuating a swinging link coupled to a heddle frame. Overall that equipment gives satisfaction.

When a lifting unit is coupled to the rotary movement of the main shaft of a dobby, the forces transmitted between the disk and the eccentric pass in alternation from one latch to the other. One latch transmits the drive force for driving the lifting unit, while the other is driven by the return force that corresponds to the energy returned by the lifting unit to the main shaft. The driver latch operates during the driver stage in the movement of the main shaft, i.e. when the acceleration and the speed of the connected frame have the same sign. The driven latch is loaded during the driven stage of the motion from the main shaft, i.e. when the acceleration and the speed of the frame are of different signs. A connected frame performs a go-and-return movement in one complete rotation of the main shaft. It is possible to decouple the movement of the main shaft when it reaches a selection range, in the vicinity of its two extreme positions. These selection ranges correspond to force being transferred between the latches that work respectively during the driving stage and during the driven stage.

When a lifting unit is in motion, the latches are engaged in a corresponding notch of the drive disk and they bear against corresponding surfaces of the disk. When it is appropriate to stop a lifting unit, the selection device thus needs to act on the latches in order to disengage them from said notches, even though the latch that is working during the driven stage is heavily loaded. The reader arm therefore needs to act powerfully and quickly on the latch, which requires the means for acting on the latches to be dimensioned so as to accommodate the intense forces that are to be delivered. As a result, the latch control elements present a large amount of inertia, and that can limit the operating speeds of known dobbies.

SUMMARY OF THE INVENTION

The invention seeks more particularly to respond to these limitations by proposing a novel rotary dobby in which the speed of operation can be further increased compared with that of known dobbies, while its operation continues to remain reliable.

To this end, the invention relates to a rotary dobby for a loom, comprising for each of its lifting units:

- a swinging part coupled to a heddle frame and associated with an actuator element mounted loose on a main shaft of the dobby;
- a drive element constrained to rotate with the main shaft;
- two controlled latches for coupling the drive element and the actuator element in rotation, each latch being mounted on the actuator element, a first latch being provided with a first surface for selectively bearing against at least one corresponding first surface of the drive element, these first surfaces forming an interface for transmitting a driving force from the drive element to the actuator element, while a second latch is provided with a second surface for selectively bearing against at least one corresponding second surface of the drive element, these second surfaces forming an interface for transmitting a return force from the actuator element to the drive element;
- first resilient bias means for resiliently biasing each of the latches towards a configuration in which their respective bearing surfaces are engaged with the corresponding surfaces of the drive element; and
- control means for moving the latches against the action of the first resilient bias means.

This dobby is characterized in that the first resilient bias means act directly on the first latch and indirectly on the second latch, and in that the control means are suitable for moving the first latch against the action of the first resilient bias means while the second latch remains in the configuration in which its bearing surface is engaged with the second surface of the drive element.

By means of the invention, it is possible via the control means to actuate directly only the first latch through which the driving force of the main shaft is transmitted to the actuator element and to the heddle frame, whereas the second latch, which is under load, can remain in place while the dobby is in a driven stage receiving drive from the main shaft, until it passes into a driving stage. The second latch can then be disengaged easily from the corresponding surface of the drive element.

According to aspects of the invention that are advantageous but not compulsory, such a dobby may incorporate one or more of the following features:

- The first resilient bias means act on the second latch through the first latch.
- It includes second resilient bias means that act on the second latch, but not on the first latch, exerting a force for disengaging the bearing surface of the second latch from the corresponding second surface of the drive element.
- The control means comprise a moving member acting directly on the first latch to exert a force for moving it against the action of the first resilient bias means, and resilient means for transmitting force between firstly the moving member or the first latch, and secondly the second latch.
- The resilient force transmission means comprise a compression spring or a spring blade.
- The resilient force transmission means are disposed between the moving member and the second latch.
- The resilient force transmission means are disposed between the first and second latches.
- The control means comprise a moving member acting directly on the first latch to exert a force for moving it against the action of the first resilient bias means, and auxiliary resilient bias means biasing the second latch in the direction for disengaging its bearing surface from the corresponding second surface of the drive element, these auxiliary bias means being suitable for disengaging the bearing surface of the second latch from the corresponding second surface of the drive element only when the second latch is not subjected to the action of the first resilient bias means, because of a movement of the first latch relative to the force exerted by the moving member. In such a case, the moving member may be formed by a pusher mounted on the actuator element and movable in translation along a radius relative to the axis of rotation of the main shaft.

The invention also provides a weaving loom fitted with a dobby as described above. Such a loom can operate at higher speeds than those in the state of the art.

In another aspect, the invention provides a subassembly, sometimes referred to as a "dobby lifting unit", which belongs to a dobby as mentioned above, and which comprises an eccentric forming an actuator element, a link mounted on the eccentric, and a pivot arm for providing the connection between the link and a heddle frame. Such a subassembly can be mounted as a functional unit provided with the above-mentioned latches, to serve as a spare part for a dobby.

Finally, the invention also provides a method of controlling a dobby as described above, and more specifically a method in which, during decoupling of the drive element and the actuator element:

a) action is taken on the first latch against the action of the first resilient bias means in the direction to disengage its bearing surface from the corresponding first surface of the drive element, without acting directly on the second latch; and b) auxiliary means are allowed to act on the second latch to disengage its bearing surface from the corresponding second surface of the drive element.

By means of the method of the invention, rotary decoupling between the drive element and the actuator element can be initiated while the main shaft of the dobby and the drive element are still moving, at the end of an angular stroke of 180°. The second latch is disengaged automatically under the effect of the auxiliary means.

BRIEF DESCRIPTION OF THE DRAWINGS

The invention can be better understood and other advantages thereof appear more clearly in the light of the following description of four embodiments of dobbies in accordance with the principle of the invention and its control method, given purely by way of example and made with reference to the accompanying drawings, in which.

DESCRIPTION OF THE PREFERRED EMBODIMENTS

Figure 1:
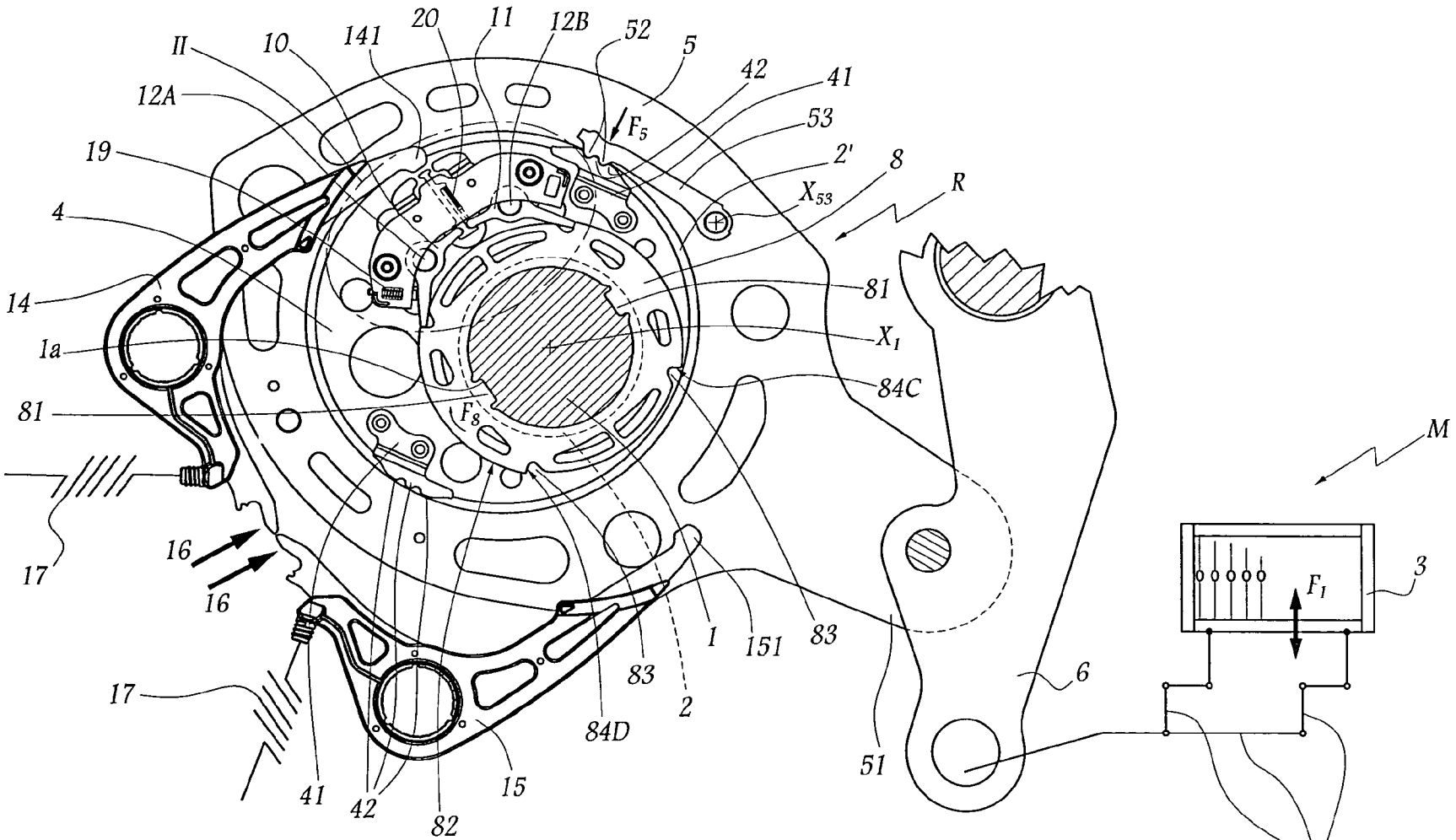
FIG. 1 is a diagrammatic view showing the principle of a loom in accordance with the invention including a dobby in accordance with the invention.

The dobby R shown in FIG. 1 comprises a main shaft 1 driven with intermittent rotary motion, stopping every half turn. The shaft 1 receives a bearing series 2 equal in number to that of the heddle frames or of the lifting units 3 of the weaving loom M. Each bearing 2 has an eccentric 4 mounted loose thereon and having the opening of a swinging link 5 mounted loose thereabout on a second bearing 2'. The free end 51 of the link 5 is coupled to a pivot arm 6 which acts via a linkage 61 to move a heddle frame 3 vertically, with vertically oscillating motion represented by double-headed arrow $F_1$ in FIG. 1, the heddle frame 3 being shown very diagrammatically in order to clarify the figure.

The axis of rotation of the shaft 1 is referenced $X_1$.

Between two eccentrics 4, the shaft 1 is constrained to rotate with a drive disk 8 having a central opening that is substantially circular and provided with two teeth 81 engaged in longitudinal grooves 1*a* of corresponding shape formed in the periphery of the shaft 1. The peripheral edge 82 of the disk 8 is provided with four notches 83 that define four shoulders 84A, 84B, 84C, and 84D formed in the thickness of the edge surface of the disk 8.

Two latches 10 and 11 are hinged about two respective pins 12A and 12B secured to the eccentric 4 and each defining a pivot axis $X_{10}$, $X_{11}$ for a respective latch 10 or 11. The axes $X_{10}$ and $X_{11}$ are parallel to the axis $X_1$.

The latch 10 comprises a first arm 101 that extends generally radially relative to the axis $X_{10}$ and having an end 102 that can be engaged in two of the notches 83 in such a manner that its end surface 103 can then come to bear against one of the shoulders 84A and 84C. The latch 10 also has a second radial arm 104 whose end 105 is engaged in a fork formed at the end 131 of a pusher or slider 13 mounted on the eccentric 4 and movable in translation in both directions along a radius $D_1$ relative to the axis $X_1$, as represented by double-headed arrow $F_2$.

The second latch 11 has the same shape as the first latch 10 and comprises two arms 111 and 114 that extend radially relative to the axis $X_{11}$ and having respective ends 112 and 115 for co-operating respectively with the shoulders 84B and 84D, and with the pusher 13. The end surface 113 of the arm 111 is for bearing selectively against the shoulders 84B and 84D.

Figure 2:
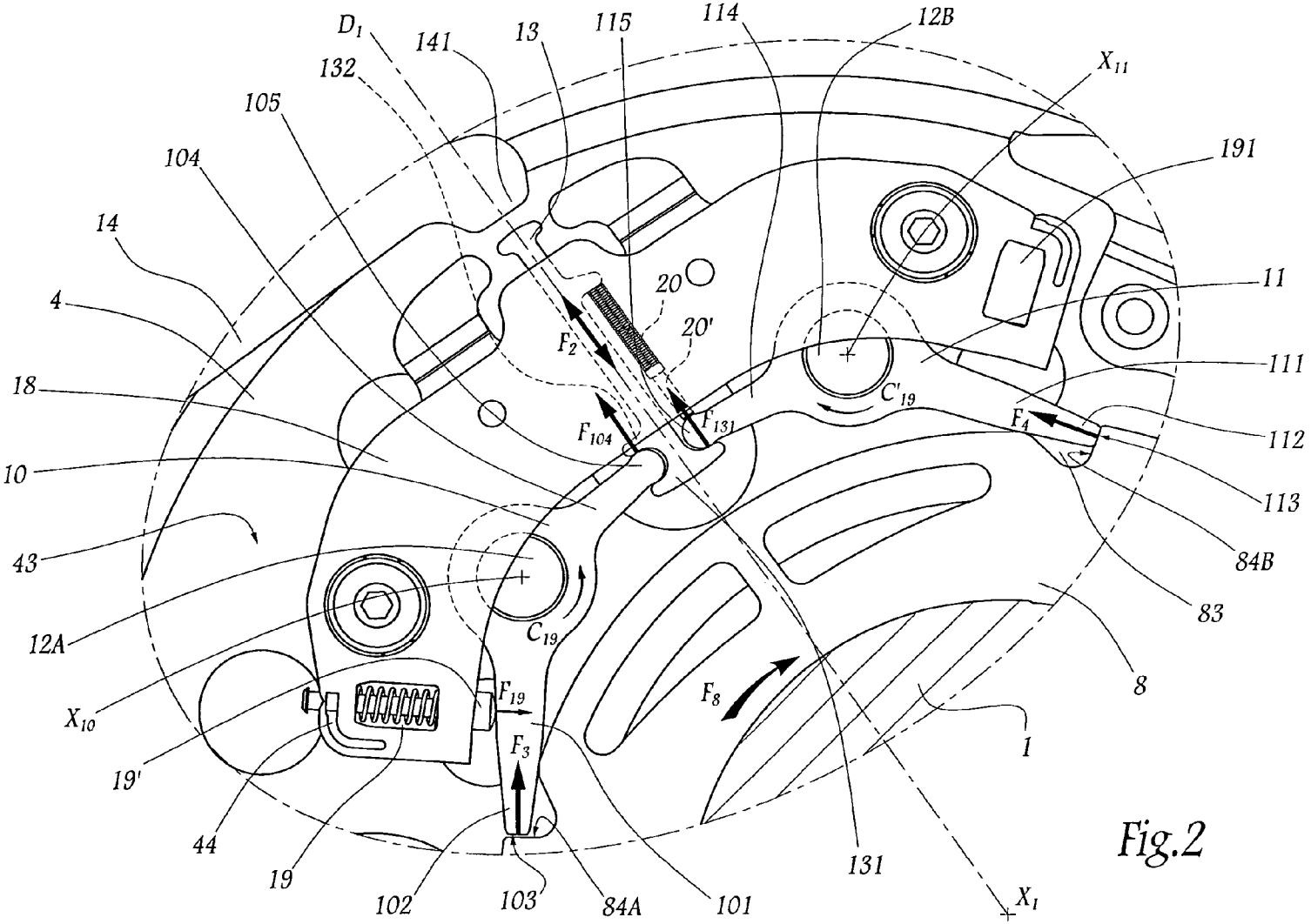
FIG. 2 is a view on a larger scale showing a detail II of FIG. 1.

When the disk 8 is driven by the shaft 1 in the direction of arrow $F_8$ in FIGS. 1 and 2, the surfaces 103 and 84A form an interface for transferring a drive force $F_3$ from the disk 8 to the eccentric 4.

The return force $F_4$ corresponding to the braking energy delivered by the lifting unit, in particular at the end of the shaft 1 turning through 180° about the axis $X_1$, is transmitted to the eccentric 4 by the surface 113 bearing on the shoulder 84B. The same applies respectively at the interfaces between firstly the surfaces 103 and 84C, and secondly the surfaces 113 and 84D, when the latches are engaged in the other two notches 83.

The pusher or slider 13 is designed to be actuated by the tip 141 or 151 of an oscillating lever 14 or 15 controlled by a reader device represented by two arrows 16 in FIG. 1. The levers 14 and 15 are subjected to the action of two return springs 17 urging the tips 141 and 151 into engagement with the pusher 13 against the action the reader device 16.

The eccentric 4 has two tabs 41 provided with teeth 42 for engaging with corresponding teeth 52 formed at the free end of an arm 53 mounted to pivot about an axis $X_{53}$ on the link 5 and subjected to the action $F_5$ of resilient means (not shown) urging the teeth 42 and 52 into engagement. The elements 41 and 53 form two fixed-point devices, one of which comes automatically into engagement when the shaft 1 reaches one or the other of its two diametrically-opposite stop positions, and is automatically disengaged when the eccentric 4 leaves its stop position under drive from the disk 8 by means of the latches 10 and 11.

A cover 18 is mounted on the eccentric 4 at a distance from the face 43 of said eccentric, as can be seen in FIG. 1. The elements 10 to 13 are received between the cover 18 and the face 43.

A compression spring 19 is placed between the face 43 and the cover 18. This spring 19 bears against an abutment 44 mounted on the eccentric 4. The spring 19 exerts a resilient force $F_{19}$ on the arm 101 of the latch 10 via a pusher 19', thereby tending to engage the end 102 of the arm 101 in a notch 83 when such a notch comes into register with the end 102.

The force $F_{19}$ imparts torque $C_{19}$ to the latch 10 about the axis $X_{10}$ in a direction such that the arm 104 exerts a force $F_{104}$ on a lateral tab 132 of the pusher 13 tending to move the pusher away from the axis $X_1$. Given the shape of the end 131 of the pusher 13 which overlaps the ends 105 and 115, the force $F_{104}$ is transmitted to the arm 114 of the lever 11 in the form of a force $F_{131}$ that tends to cause the latch 11 to turn about the axis $X_{11}$ in the opposite direction to the direction in which the latch 10 turns under the effect of the torque $C_{19}$. In other words, a torque $C'_{19}$ due to the force $F_{131}$ drives the lever 111 clockwise in FIG. 2, thus having the effect of bringing or holding the end 112 in position in a notch 83. The spring 19 and the pusher 19' thus act directly on the latch 10 and indirectly on the latch 11, via the latch 10 and the pusher 13, to bring the surfaces 103 and 113 into engagement respectively with the shoulders 84A and 84B in the configuration of FIG. 2, or with the shoulders 84C and 84D when the latches co-operate with the notches 83 that are visible in the bottom portion of FIG. 1.

Figure 3:
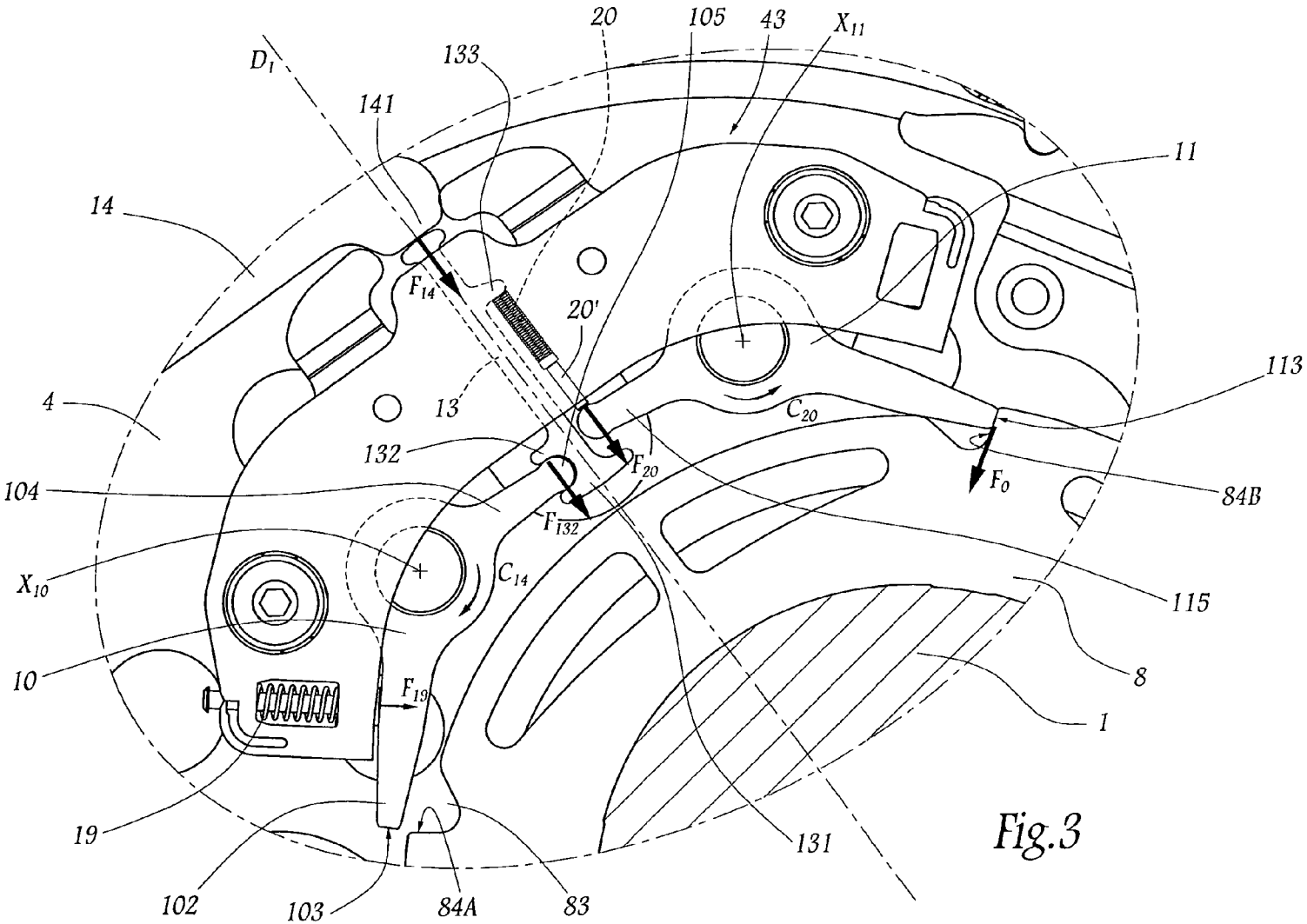
FIG. 3 is a view analogous to FIG. 2 during a first step of decoupling the drive element and the actuator element of the dobby.

As can be seen more particularly in FIG. 3, at the end of the deceleration of the shaft 1, and before it has come completely to rest, it is possible to act on the pusher 13 via the tip 141 of the lever 14 by exerting a force $F_{14}$ that moves the pusher 13 towards the axis $X_1$. The tab 132 that co-operates the end 131 of the pusher 13 to define a concave zone for receiving the end 105 then exerts on said end a force $F_{132}$ directed towards the shaft 1. This force gives rise to a torque $C_{14}$ about the axis $X_{10}$ causing the first latch 10 to turn in the direction for disengaging its end 102 from the notch 83 in which it was previously engaged. This maneuver can be performed quickly since during the stage in which the shaft 1 is decelerating, the latch 10 is unloaded. In other words, the contact pressure between the surfaces 103 and 84A is then substantially zero. The movement of the latch 10 under the effect of the torque $C_{14}$ takes place against the resilient force $F_{19}$.

The contact pressure between the surfaces 113 and 84B is high. The latch 11 is bearing simply on the end 131 of the pusher 13. Adjacent to the end 115, there is no tab equivalent to the tab 132 of the pusher 13, so no force equivalent to the force $F_{132}$ is transmitted to the arm 114. This enables the latch 11 to remain in a configuration in which its surface 113 is engaged with the shoulder 84B while the latch 10 is moving under the effect of the force $F_{14}$.

A tab 133 is disposed on the side of the pusher 13 opposite to the side having the tab 132. A compression spring 20 and a pusher 20' are interposed between the tab 133 and the end 115. The compression spring acts on the end 115 and via the pusher 20 to exert a resilient force $F_{20}$ that imparts a torque $C_{20}$ on the latch 11 about the axis $X_{11}$, thereby tending to cause said latch to pivot about the axis $X_{11}$ in the direction for disengaging its surface 113 from the shoulder 84B.

The stiffness of the spring 20 is selected in such a manner that the torque $C_{20}$ does not overcome the friction force $F_0$ that exists at the interface between the surfaces 113 and 84B while the shaft 1 is decelerating. The magnitude of the return force transmitted by the disk 8 to the eccentric 4 causes the friction force $F_0$ to be intense. In contrast, as soon as the disk 8 and the eccentric 4 have stopped, after the shaft 1 has finished a half-turn, the torque $C_{20}$ is sufficient to disengage the end 112 from the notch 83 in which it was previously received. By means of the successive disengagements of the latches 10 and 11, this leads to complete decoupling of the drive element, constituted by the disk 8, from the element for actuating the link 5, as formed by the eccentric 4.

From the above, it follows that the force $F_{14}$ can be exerted on the pusher 13 in a manner that is early relative to the stop positions of the lifting unit, such that the speed of rotation of the shaft 1 can be increased. The decoupling between the drive element and the actuator element 4 takes place in two steps that are slightly offset in time and that correspond respectively:

a) to the latch 10 disengaging; and b) to the latch 11 disengaging.

The number of parts to be moved in order to decouple the disk 8 from the eccentric 4 is small, thus also enabling high operating speeds to be reached and obtaining increased reliability for the dobby.

Figure 4:
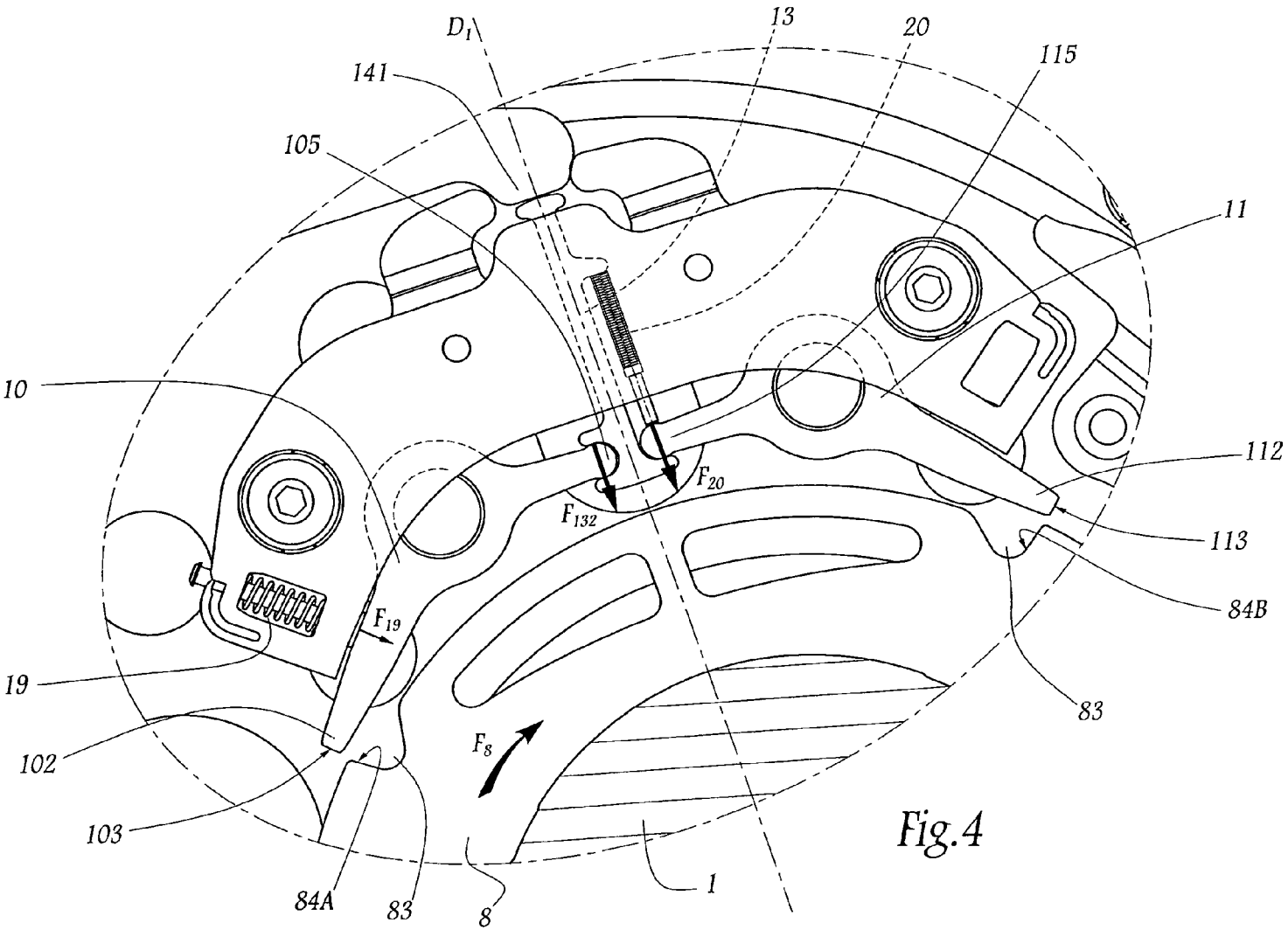
FIG. 4 is a view analogous to FIG. 2 during a second decoupling step.

At the end of the decoupling operation, the parts constituting the dobby are in the configuration of FIG. 4, where, providing the eccentric 4 does not need to be driven, the disk 8 can follow the shaft 1 through rotation of 180° in the direction of arrow $F_8$ so as to bring the shoulders 84C and 84D respectively into the configuration of the shoulders 84A and 84B in FIG. 3. If the force $F_{14}$ is then eliminated, because of the action of the reader device 16, then the latches 10 and 11 engage in the notches 83 under the effect of the action $F_{19}$ of the spring 19 when the notches 83 bordered by the shoulders 84C and 84D come into register with the ends 102 and 112.

If it is necessary to make the dobby operate in reverse, in particular after a warp yarn has broken, it is possible to stop the eccentric 4 by acting on the pusher 13. Under such circumstances, the speed of rotation of the shaft 1 is much slower than when it is operating forwards, and so the slight delay observed for disengaging the latch 11 compared with the disengagement of the latch 10 is not harmful.

Figure 5:
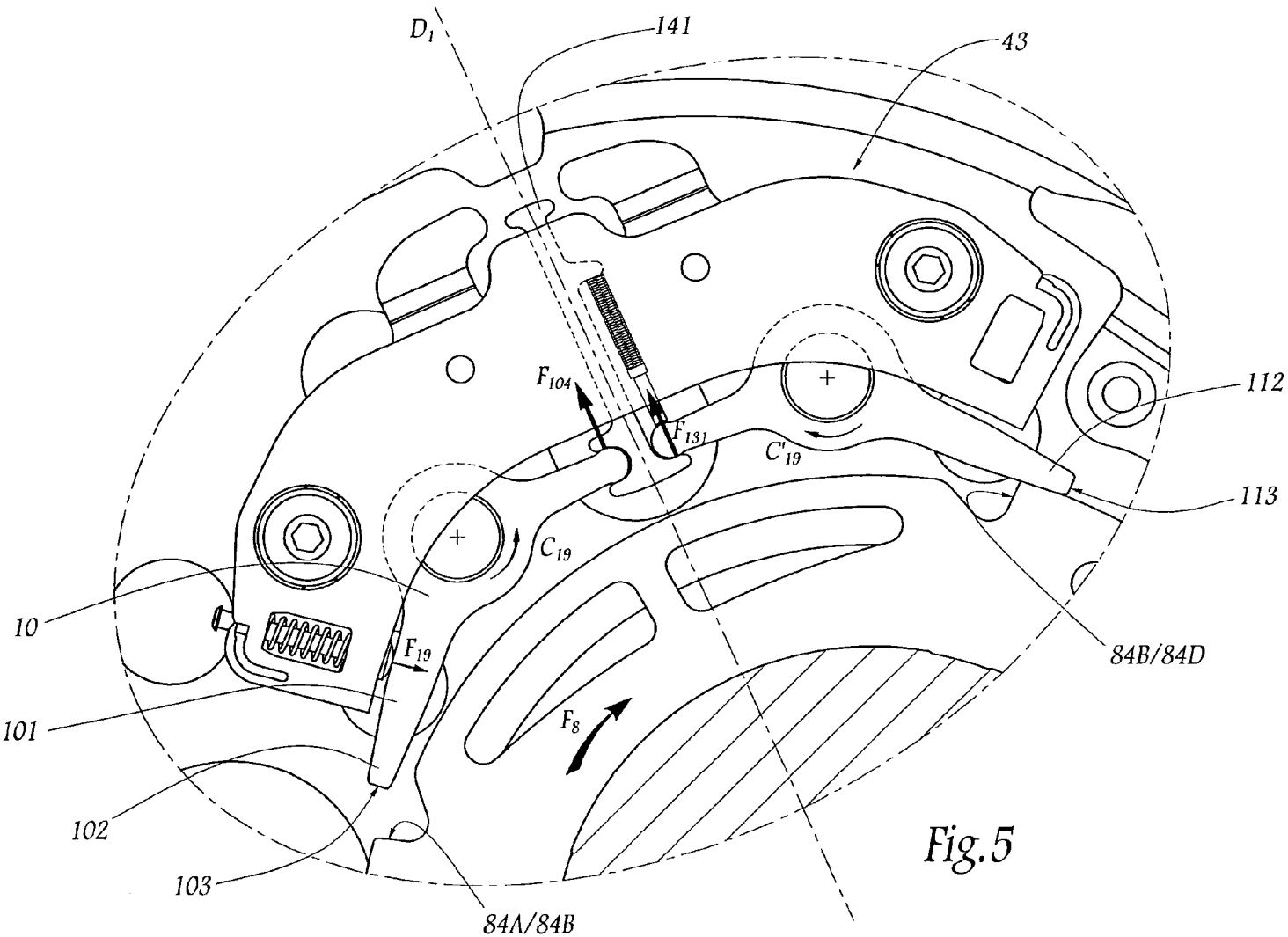
FIG. 5 is a view analogous to FIG. 2 during relative movement between the drive and actuator elements.

As can be seen more clearly from FIG. 5, when the disk 8 reaches a position close to that of FIG. 3, after the shaft 1 has turned through 180° and if the force $F_{14}$ has been eliminated by the action of the reader device 16, the end 102 of the arm 101 of the latch 10 can penetrate into the corresponding notch 83 only simultaneously with the arm 111 of the latch 11. Thus, while floating, i.e. while in a situation in which the link 5 has lost its fixed point and is in an undetermined angular position, the latch 10 does not run any risk of being engaged on its own in a corresponding notch 83. The latches can become engaged in notches 83 only simultaneously, as can happen only if the speed of the shaft 1 is small. There is thus no risk of damaging the disk 8 or the latches 10 and 11.

A location 191 is provided in the vicinity of the latch 11 in order to receive a spring and a pusher analogous to the elements 19 and 19'. Thus, if the shaft 1 and the disk 8 are turning forwards in the direction opposite to arrows $F_8$, it is possible to invert the roles and the order of disengagement of the latches 10 and 11, which latches are structurally identical. Under such circumstances, it suffices to mount the spring and the pusher in the location 191 and to turn the pusher 13 round so that the spring 20 is beside the latch 10.

Figure 6:
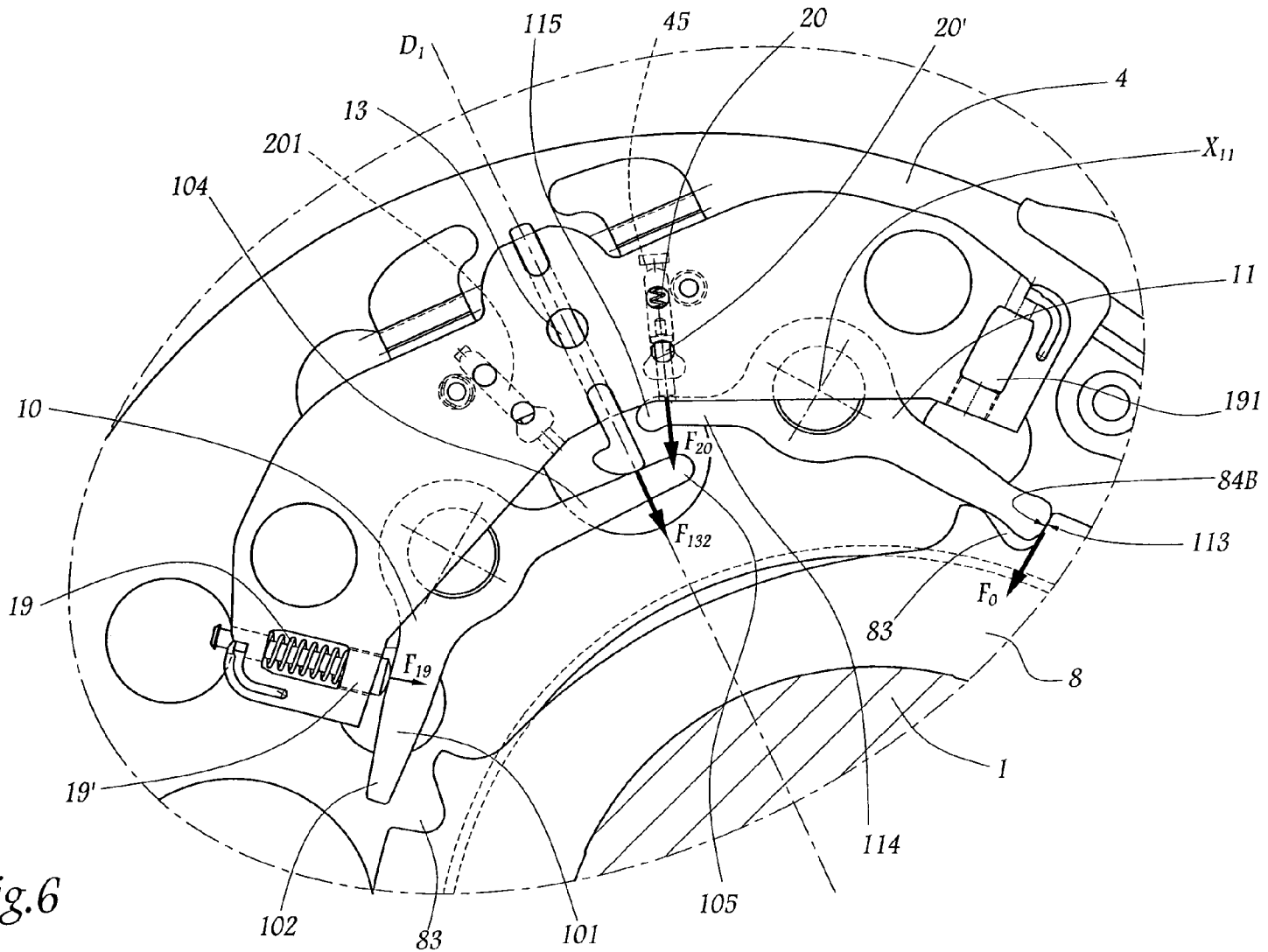
FIG. 6 is a view analogous to FIG. 3 for a dobby constituting a second embodiment of the invention.

In the second embodiment of the invention shown in FIG. 6, elements analogous to those of the first embodiment are given identical references. A spring 19 and a pusher 19' exert an elastic force $F_{19}$ on the latch 10 for engaging the end 102 of its arm in a notch 83. This force is transmitted to the latch 11 by contact between the ends 105 and 115 of their arms 104 and 114. The disk 8 turns together with the shaft 1 in the direction of arrow $F_8$. The latch 10 is used to transmit a driving force to the eccentric 4. The latch 11 is used for transmitting a return force thereto.

This embodiment differs from the above-described embodiment in that the auxiliary spring 20 and the associated pusher 20' are not inserted between a portion of the pusher or slide 13 and the latch 11, but between a stationary abutment 45 carried by the eccentric 4 and the arm 114 of the latch 11. Under such circumstances, when a disengagement force $F_{14}$ is exerted on the pusher 13, which is movable relative to the eccentric 4 along a radius $D_1$ relative to the axis of rotation of the shaft 1, the end 131 of the pusher 13 transmits this force to the arm 104 of the latch 10 in the form of a force $F_{132}$. This induces a corresponding torque $C_{14}$ which is transmitted solely to the latch 10 and which disengages the arm 101 relative to the notch 83 in which it was previously engaged. The arm 111 of the latch 11 is disengaged from the notch 83, in which it was engaged, under the effect of a torque $C_{20}$ about the pivot axis $X_{11}$ of the latch 11 due to the resilient force $F_{20}$ from the spring 20, once the friction force $F_0$ that exists at the interface between the surface 113 and the shoulder 84B can be overcome by the torque $C_{20}$.

Additional locations 191 and 201 enable the springs 19 and 20 to be mounted together with their pushers 19' and 201 in a position that is compatible with the disk 8 rotating forwards in the direction opposite to the arrow $F_8$.

Figure 7:
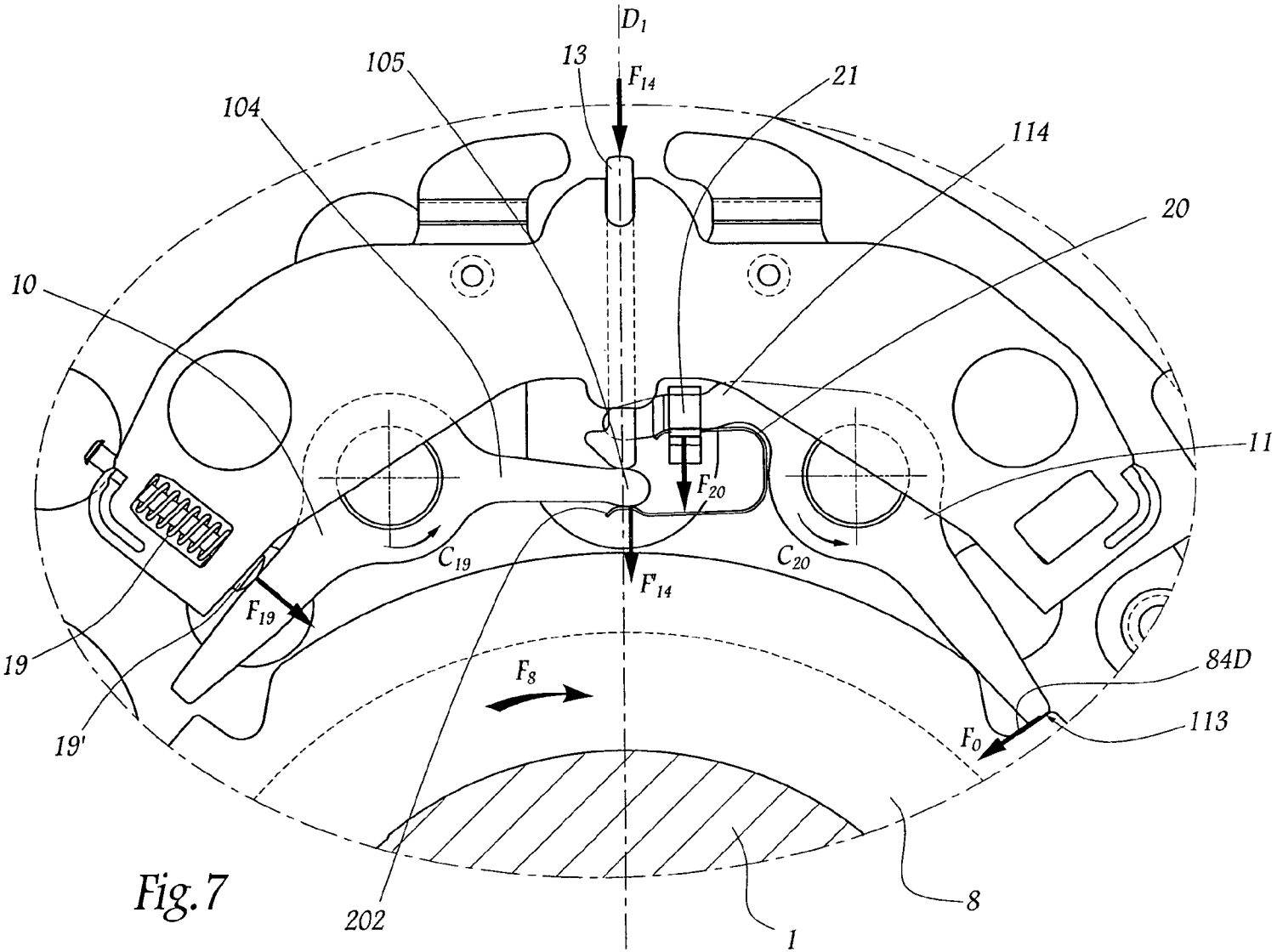
FIG. 7 is a view analogous to FIG. 3 for a dobby constituting a third embodiment of the invention.

In the third embodiment of the invention shown in FIG. 7, elements that are analogous to those of the first embodiment are given references that are identical. As above, a spring 19 and a pusher 19' exert a resilient force $F_{19}$ on the latch 10 for engaging it in a notch 83. This embodiment differs from the above embodiments in that the connection between the first latch 10 and the second latch 11 is implemented by a generally C-shaped spring blade 20 that is secured by a staple 21 to the arm 114 of the latch 11. The end 105 of the arm 104 of the latch 10 bears against a curved end 202 of the spring 20. By default, the spring 20 transmits the torque $C_{19}$ to the latch 11 by being in a configuration in which its branches are closer together than shown in FIG. 7.

As above, the pusher or slider 13 is mounted on the eccentric 4 so as to be capable of moving in translation along a radius $D_1$ relative to the axis of rotation of the main shaft 1.

When a disengagement force $F_{14}$ is exerted on the pusher 13, this force is transmitted to the arm 104 of the latch 10, against the force $F_{19}$, without being transmitted directly to the latch 11. The latch 11 is prevented from turning because of the return force applied to its surface 113. The force $F_4$ is transmitted to the latch 11 by the end 105 of the arm 104 bearing against a curved end 202 of the spring 20, thus enabling the branches of the spring 20 to be moved apart under the effect of an induced force $F'_{14}$, and then enables the force $F'_{14}$ to be transmitted to the arm 114 in the form of a resilient force $F_{20}$ of magnitude that depends on the stiffness of the spring 20. The force $F_{20}$ induces a torque $C_{20}$ about the axis $X_{11}$ that tends to turn the latch in a direction for disengaging its end 112 from the notch 83. Given the nature of the force $F_{20}$, the torque $C_{20}$ may be of small magnitude, such that the latch 11 remains engaged via its surface 113 against the shoulder 84B so long as the friction force $F_0$ is greater than the resilient force $F_{20}$.

If the forward direction of rotation of the disk 8 is reversed relative to that represented by arrow $F_8$, it suffices to turn the pusher 13 around and to interchange the latches 10 and 11.

Figure 8:
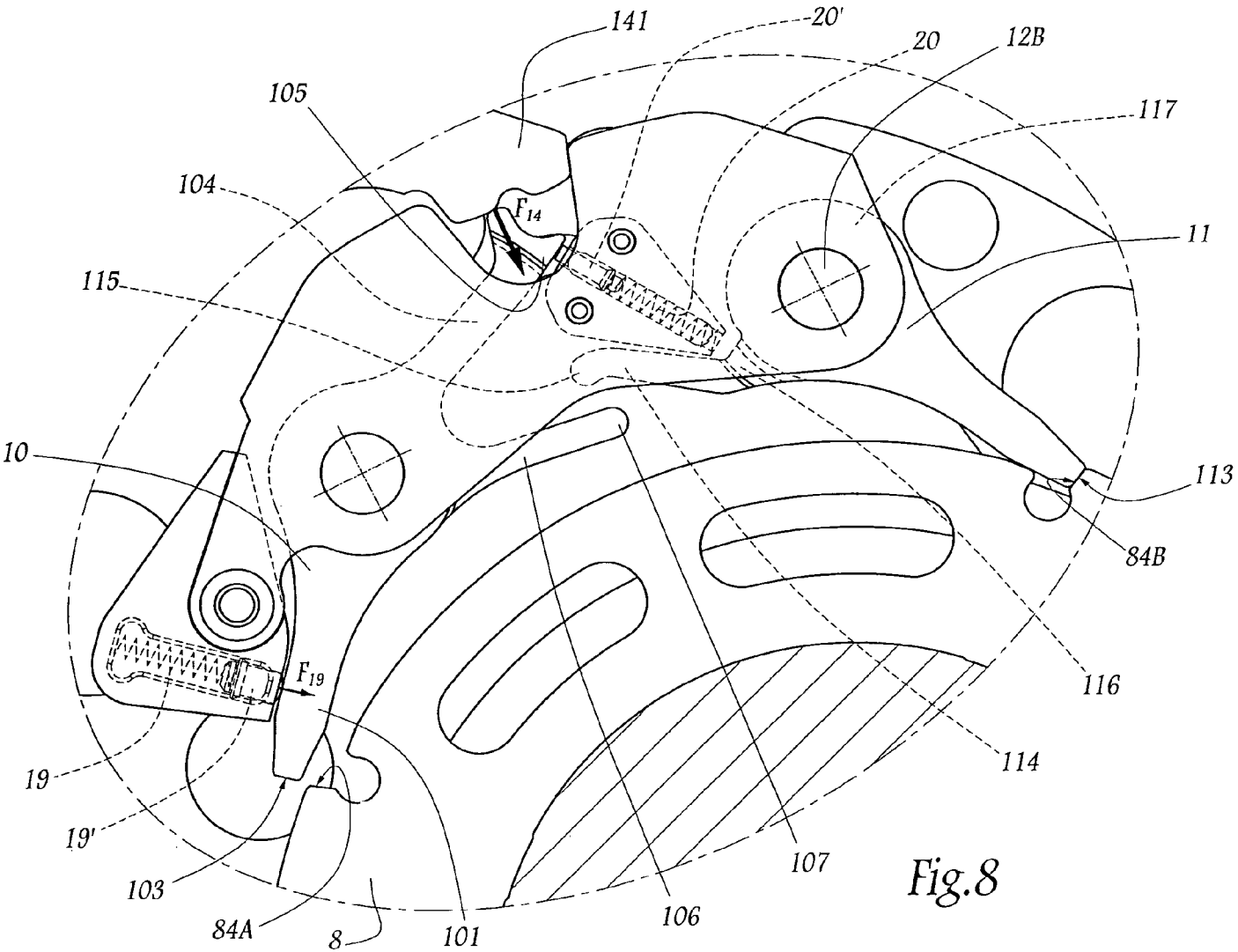
FIG. 8 is a view analogous to FIG. 3 for a dobby constituting a fourth embodiment of the invention.

In the fourth embodiment of the invention shown in FIG. 8, elements that are analogous to those of the first embodiment are given the same references. This embodiment differs from the third embodiment in that no pusher is used. A swinging lever 14 or the equivalent comes to bear via its tip 141 directly against the end 105 of the arm 104 of the latch 10. A compression spring 20 and a pusher 20' are interposed between the end 105 of the arm 104 and a junction zone 116 between the arm 114 of the latch 11 and a central portion 117 of said latch disposed around the shaft 12B.

By means of a pusher 19', a spring 19 exerts a main force $F_{19}$ on an arm 101 of the latch 10, thereby tending to bring the end surfaces 103 and 113 of the arms 101 and 111 of the latches 10 and 11 into engagement with the shoulders 84A and 84B, or the equivalent, in the disk 8. The spring 19 and the pusher 19' act directly on the latch 10. They act on the latch 11 via the end 107 of a radial third arm 106 of the latch 10 which can come to bear against the end 115 of the arm 114 of the latch 11. During decoupling, the force $F_{14}$ is transmitted to the arm 104 directly and to the arm 114 via the spring 20.

Whatever the embodiment, the means 19 and 19' resiliently loading the first latch 10 towards a configuration in which its surface 103 is in engagement with the corresponding shoulder 84A or 84C act indirectly on the second latch 11 in order to bring its surface 113 into the engaged configuration with the corresponding shoulder 84B or 84D. Mechanical decoupling between firstly the second dobby 11 and secondly the control means 13 and/or 14 of the first latch 10 makes it possible for the second latch to remain engaged in the corresponding notch 83 even though the first latch is becoming disengaged. This enables the first latch to be disengaged while the drive element constituted by the disk 8 is still decelerating, before it comes completely to rest.

The invention makes it possible to use a main shaft which does not stop every half-turn, but which slows down on reaching angular selection zones. This enables the operating speed of the loom to be increased.

The invention claimed is:

1. A rotary dobby for a loom, comprising for each heddle frame lifting unit:

a swinging part coupled to a heddle frame and associated with an actuator element mounted loosely on a main shaft of the dobby, a drive element mounted to rotate with the main shaft, two controlled latches for coupling the drive element and the actuator element in rotation, each latch being mounted on the actuator element, a first latch, of the two controlled latches, being provided with a first bearing surface for selectively bearing against at least one corresponding first surface of the drive element, these first surfaces forming an interface for transmitting a driving force from the drive element to the actuator element, a second latch, of the two controlled latches, being provided with a second bearing surface for selectively bearing against at least one corresponding second surface of the drive element, these second surfaces forming an interface for transmitting a return force from the actuator element to the drive element, first resilient bias means for resiliently biasing each of the first and second latches towards a configuration in which their respective bearing surfaces are engaged with the corresponding surfaces of the drive element, control means for moving the at least the first latch against a force exerted thereon by the first resilient bias means, and wherein the first resilient bias means only acts directly on the first latch and indirectly on the second latch to urge the first and second bearing surfaces of the first and second latches into engagement with the corresponding first and second surfaces of the drive element and wherein the control means moves the first latch against the force of the first resilient bias means to disengage the first bearing surface from the corresponding first surface of the drive element, while the second latch remains in a position in which its second bearing surface is engaged with the second corresponding surface of the drive element.

2. A dobby according to claim 1, wherein the first resilient bias means acts indirectly on the second latch through the first latch.

3. A dobby according to claim 1, including a second resilient bias means that acts on the second latch, but not on the first latch, the second resilient bias means exerting a force for disengaging the second bearing surface of the second latch from the corresponding second surface of the drive element.

4. A dobby according to claim 1, wherein the control means includes:

a moving member acting directly on the first latch to exert a force for moving it against a force of the first resilient bias means; and another resilient means for transmitting a force between firstly, one of the moving member or the first latch, and secondly, the second latch.

5. A dobby according to claim 4, wherein the another resilient means for transmitting a force is selected from a group of resilient means consisting of a compression spring and a spring blade.

6. A dobby according to claim 4, wherein the another resilient means for transmitting a force is disposed between the moving member and the second latch.

7. A dobby according to claim 4, wherein the resilient means for transmitting a force is disposed between the first and second latches.

8. A dobby according to claim 1, wherein the control means includes:

a moving member acting directly on the first latch to exert a force for moving the first latch against a force of ion of the first resilient bias means; and auxiliary resilient bias means biasing the second latch in a direction for disengaging the second bearing surface from the corresponding second surface of the drive element, the auxiliary bias means being operable to disengage the second bearing surface of the second latch from the corresponding second surface of the drive element only when the second latch is not subjected to an indirect force of the first resilient bias means, because of a movement of the first latch against the force of the first biasing means due to a force exerted by the moving member on the first latch.

9. A dobby according to claim 8, wherein the moving member is formed by a pusher mounted on the actuator element and movable in translation along a radius relative to an axis of rotation of the main shaft.

10. A weaving loom (M) including a dobby according to claim 1.

11. A dobby according to claim 1, having a subassembly for each heddle frame lifting unit wherein the actuator element includes an eccentric, a link mounted on the eccentric, and a pivot arm for providing a connection between the link and a heddle frame.

12. A method of controlling a rotary dobby including for each of its heddle frame lifting units:

a swinging part coupled to a heddle frame and associated with an actuator element mounted loose on a main shaft of the dobby, a drive element mounted to rotate with the main shaft, two controlled latches for coupling the drive element and the actuator element in rotation, each latch being mounted on the actuator element, a first latch of the two controlled latches being provided with a first bearing surface for selectively bearing against at least one corresponding first surface of the drive element, these first surfaces forming an interface for transmitting a driving force from the drive element to the actuator element, while a second latch of the two controlled latches is provided with a second bearing surface for selectively bearing against at least one corresponding second surface of the drive element, these second surfaces forming an interface for transmitting a return force from the actuator element to the drive element, first resilient bias means for resiliently biasing each of the first and second latches towards a configuration in which their respective first and second bearing surfaces are engaged with the corresponding first and second surfaces of the drive element, and control means for moving at least the first latch against a force exerted by the first resilient bias means;

the method during decoupling of the drive element from the actuator element including the steps of:

a) placing a force on the first latch against the action of the first resilient bias means in a direction to disengage its first bearing surface from the corresponding first surface of the drive element, without placing a force directly on the second latch; and b) placing an auxiliary force on the second latch to disengage its second bearing surface from the corresponding second surface of the drive element.

13. A dobby according to claim 1, wherein the control means moves the first and second latches against the action of the first resilient bias means.

* * * * *